US005567279A

United States Patent [19]

Phillips et al.

[11] Patent Number: 5,567,279

[45] Date of Patent: Oct. 22, 1996

[54] VARIABLE STAGE PRESSURE DIFFUSER

[75] Inventors: Joseph R. Phillips; John D. Weston; Victor L. Bilodeau; Ronald G. Bain; Mark D. Barrett; Brian F. Greenwood; John Pietrangelo, all of Glens Falls, N.Y.

[73] Assignee: Ahlstrom Machinery Inc., Glens Falls, N.Y.

[21] Appl. No.: 801,651

[22] Filed: Dec. 2, 1991

Related U.S. Application Data

[63] Continuation-in-part of Ser. No. 685,400, Apr. 16, 1991.

[51] Int. Cl.[6] ..... D21C 9/04

[52] U.S. Cl. ..... 162/232; 162/251; 162/60; 210/323.2; 210/499; 68/181 R; 68/184

[58] Field of Search ..... 210/323.2, 499, 210/324, 330, 331; 162/251, 60, 19, 380, 232; 8/156; 68/181 R, 184, 190, 18 F

[56] References Cited

U.S. PATENT DOCUMENTS

| | | | |
|---|---|---|---|
| 3,807,202 | 4/1974 | Gunkel | 68/181 R |
| 4,157,302 | 6/1979 | Bergstedt | 68/181 R |
| 4,375,410 | 3/1983 | Richter et al. | 162/251 |
| 4,535,497 | 8/1985 | Jacubsen | 8/156 |
| 4,547,264 | 10/1985 | Sherman | 162/251 |

*Primary Examiner*—Steve Alvo
*Attorney, Agent, or Firm*—Nixon & Vanderhye P.C.

[57] ABSTRACT

Located within the annular screen of the pressure diffuser is a tubular baffle hung from adjacent the top of the vessel. The baffle has two headers disposed on its inner surface, with openings in the tube providing communication between the exterior of the tube and the headers. A conduit extends from each header to an arm at the top of the vessel, to allow extracted liquid to be discharged. Another extraction conduit is provided at the bottom of the vessel, in communication with the screen interior and the tubular baffle interior. Treatment liquid, such as wash liquid, may be introduced at two, three, or more positions along the vessel with the liquid extracted from the first and second headers being introduceable at different positions along the vessel. A flexible, elastomeric material, sealing element with integral annular skirt may extend from the bottom end of the tubular baffle and engage the screen to provide a seal minimizing mixing between stages.

21 Claims, 7 Drawing Sheets

VARIABLE STAGE PRESSURE DIFFUSER

CROSS-REFERENCE TO RELATED APPLICATION

This application is a continuation in part of application Ser. No. 07/685,400 filed Apr. 16, 1991, the disclosure of which is hereby incorporated by reference herein.

BACKGROUND AND SUMMARY OF INVENTION

Conventional pressure diffusers, such as those sold by Kamyr, Inc. of Glens Falls, N.Y. under the trademark "MC®", are typically one stage. Some partial two stage units—attempting to gain the advantages for multi-stage units often achieved in atmospheric diffusers—are in use with no interval separation between stages, and are relatively inefficient. Attempts at full two-stage operation, or variable stage operation, have not been commercially successful to date.

In view of the fact that the pressure diffusers operate at a pressure that is always substantially greater than one atmosphere throughout passage of the pulp being treated through the vessel, there have been perceived impediments to multi-stage configurations. Perhaps the largest perceived impediment in conventional thinking is that there is no good way to divide the flow without resulting in channeling of the pulp, or plugging of the screens, and that mixing between the extraction flows of the different stages would occur thereby destroying the benefits of a multi-stage approach.

In the parent application, a practical two stage pressure diffuser was provided. While that diffuser is eminently suitable for situations where two stages are practiced, there are many circumstances where it is desired to be able to vary the number of stages. For example sometimes it is desirable to operate the diffuser on less than two full stages (such as 1¾, 1 ½, or 1 and ¼ stages), and the pressure diffuser in the parent application does not practically allow such practice. Therefore, according to the invention modifications have been made to the pressure diffuser in the parent application in order to allow variable stage operation in a practical way. The primary modifications that have been made are to provide an open bottom for the tubular baffle of the diffuser in the parent application, and to provide a pair of vertically spaced interior headers located within the baffle, and connected by conduits to extraction arms at the top of the vessel. Also, treatment liquid may be introduced at more than two different points along the height of the diffuser vessel.

According to one aspect of the present invention, a screen and baffle assembly for a treatment vessel is provided. Such an assembly comprises: An annular screen assembly elongated in a first dimension about an axis and having first and second ends, and defining an interior volume. Bearing means disposed at the first end of the screen assembly. Connection means disposed at the second end of the screen assembly, adapted to connect the screen assembly to a power source. An inner hollow cylinder mounted within the screen assembly and elongated in the same dimension of elongation as the screen assembly, and coaxial therewith and having a first end and a second end. The inner cylinder and the screen assembly bearing means engaging at the first end of each. The cylinder having a length roughly about 55–75% of the screen assembly length. And, means defining a first plurality of radially extending openings in the cylinder adjacent the second end thereof, and communicating with a first header disposed interiorly of the inner cylinder, with a first conduit extending from the header to the exterior of the vessel. The assembly also further comprises means defining a second plurality of radially extending openings in the cylinder between the first and second ends thereof, and communicating with a second header disposed interiorly of the inner cylinder, with a second conduit extending from the second header to the exterior of the vessel. First, second, and preferably third (or more) liquid treatment introduction means are provided vertically spaced along the vessel. As is conventional, the screen assembly is reciprocated up and down within the vessel.

Also, according to the invention a separate sealing means may be provided at the end of the cylinder, engaging the screen assembly, to prevent mixing between stages. The sealing means may be an annular element of elastomeric material, such as ethylene propylene rubber, with an annular skirt biased into engagement with the screen. This sealing means may also be provided on the cylinder in the two stage assembly of parent application Ser. No. 07/685,400 filed Apr. 16, 1991.

According to another aspect of the present invention, a pulp treating apparatus is provided which comprises the following elements: A generally upright, liquid-tight, pressurized vessel defining a first interior volume for containing pulp to be treated under pressure. A pulp inlet to the vessel. A pulp outlet from the vessel, the pulp flowing generally vertically between said pulp inlet and the pulp outlet. A screen assembly defining a surface of revolution upstanding within the vessel and defining, in part, the first interior volume containing pulp. Extraction means for withdrawing liquid from the pulp, through the screen, and including means defining a second interior volume within the vessel for receiving the extracted liquid, the extraction means comprising first, second and third extraction mechanisms vertically spaced from each other within the second interior volume, for extracting liquid at three different points within the second interior volume. First treatment liquid introduction means for introducing a first treatment liquid into the first interior volume. And, second treatment liquid introduction means vertically spaced from the first treatment liquid introduction means, and for introducing a second liquid, distinct from the first liquid, into the first interior volume.

The apparatus further preferably comprises headers disposed within the interior of the screen assembly, with first and second conduits extending from the headers to the exterior of the vessel; and wherein the third extraction mechanism comprises a conduit in communication with the second interior volume, the conduit at the bottom of the vessel. The apparatus also desirably includes an interior cylinder mounted within the surface of revolution screen assembly and radially spaced therefrom, and means defining a plurality of openings in the cylinder adjacent each of the first and second headers so that extracted liquid may freely flow into the headers through the cylinder at the openings, the cylinder having an open bottom so that the interior of the cylinder is in communication with the second interior volume, and third extraction mechanism; and a third liquid introduction means is also preferably provided.

According to yet another aspect of the present invention a method of treating comminuted cellulosic fibrous material suspension is provided. The method comprises the steps of: (a) Introducing the suspension under pressure into one end of the vessel so that it flows vertically within the first interior volume, the suspension being maintained at a pressure substantially greater than one atmosphere throughout its passage in the vessel. (b) Extracting liquid through the screen assembly into the second interior volume, the liquid being withdrawn from the suspension in the first interior volume. (c) Introducing a first treatment liquid through the circumferential side walls of the vessel at a first vertical portion of the vessel. (d) Introducing a second treatment liquid, distinct from the first treatment liquid, at a second vertical portion of the vessel distinct and vertically spaced from the first vertical portion of the vessel. (e) Withdrawing the extraction liquid from three different vertical portions within the vessel. And, (f) reintroducing some of the withdrawn liquid from step (e) as the second treatment liquid.

It is the primary object of the present invention to provide a variable pressure diffuser, and method of pressure diffusion treatment (e.g. washing) of cellulosic pulp using such a device. This and other objects of the invention will become clear from an inspection of the detailed description of the invention, and from the appended claims.

DETAILED DESCRIPTION OF THE DRAWINGS

Figure 1A:
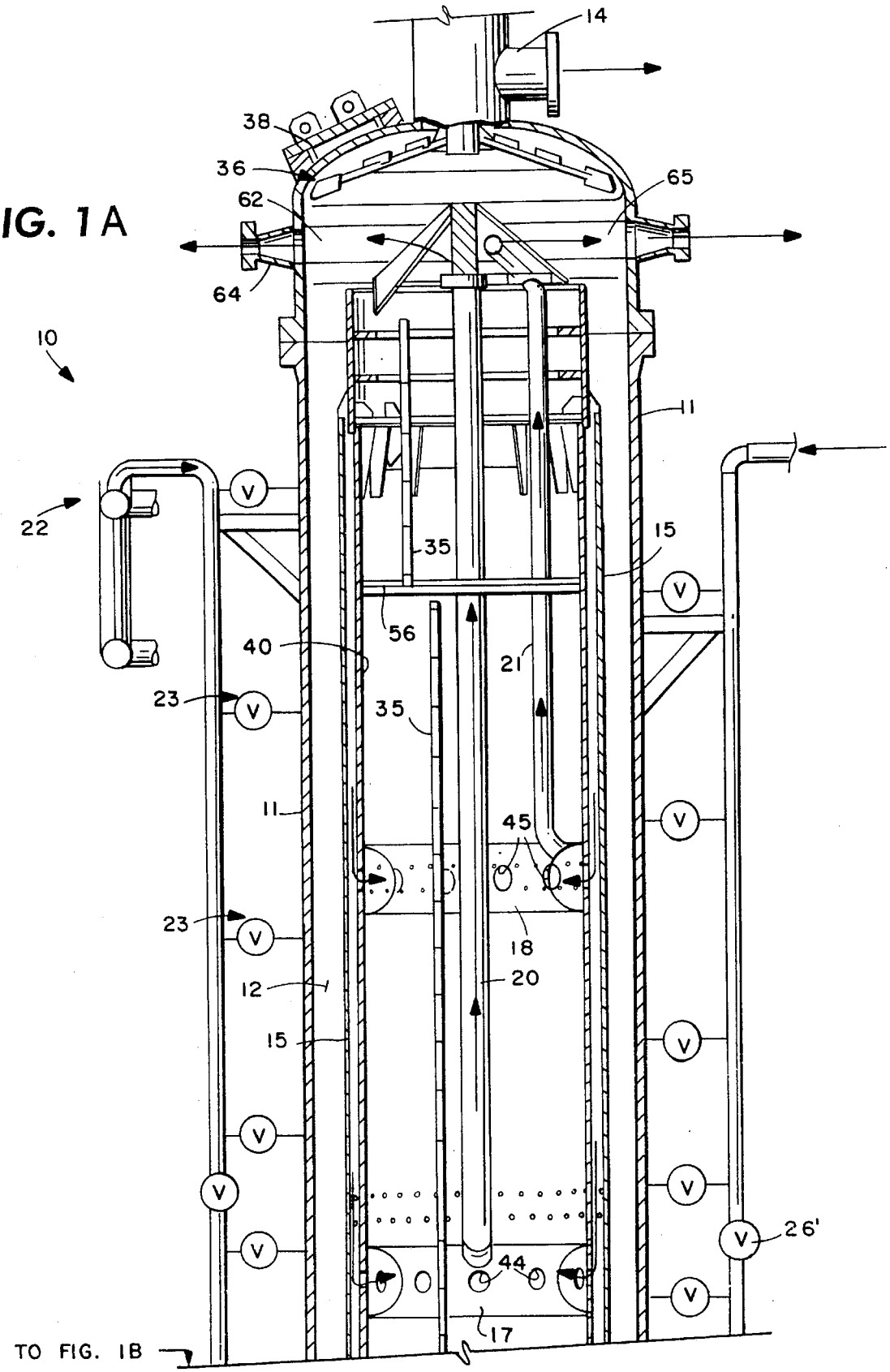
FIGS. 1A and 1B comprise a side schematic cross-sectional view of an exemplary variable pressure diffuser according to the present invention.
Figure 1B:
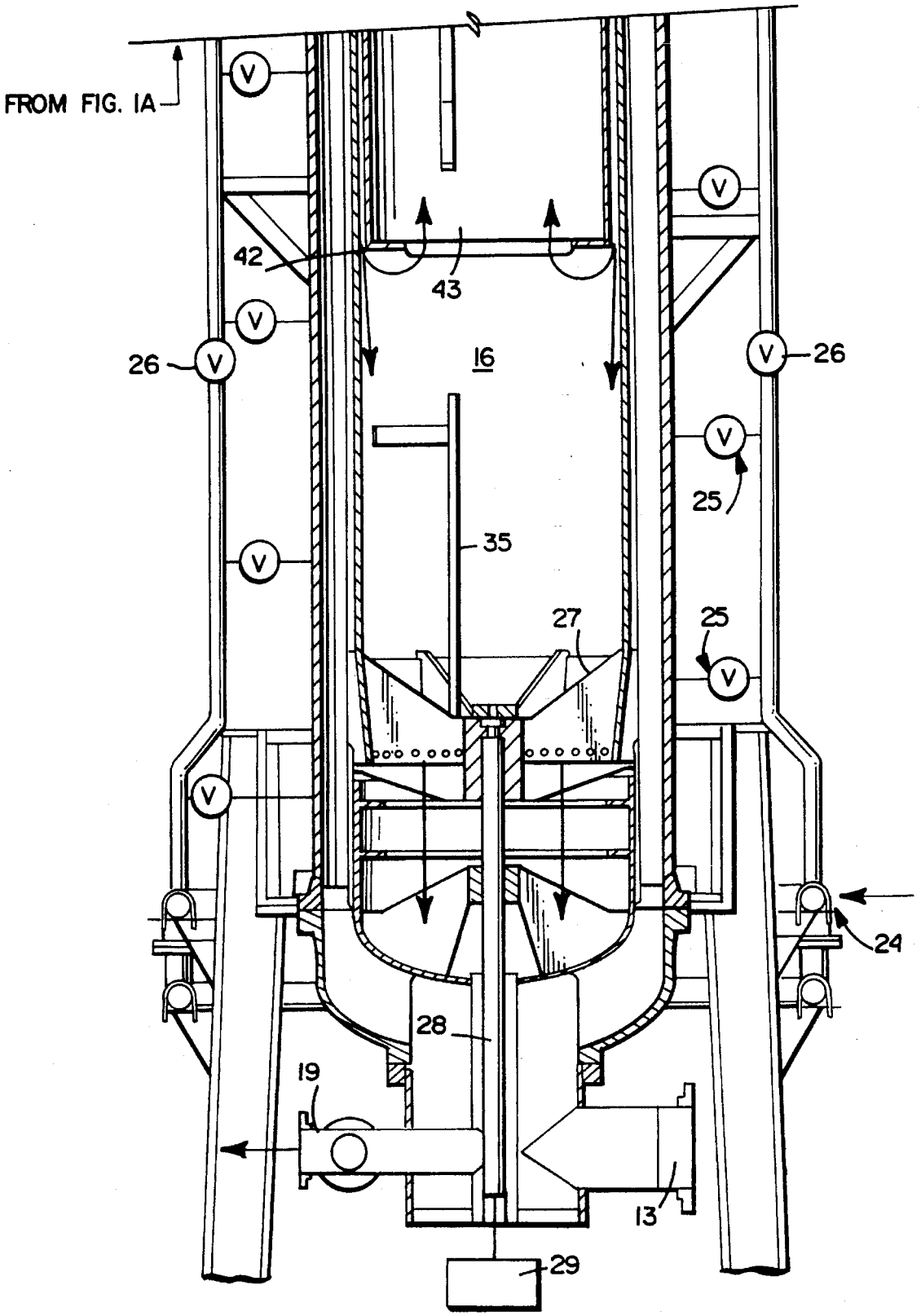

An exemplary variable pressure diffuser according to the invention is shown generally by reference numeral 10 in FIGS. 1A and 1B. The pressure diffuser 10 comprises a generally upright, liquid tight, pressurized vessel 11, defining a first interior (annular) volume 12 for containing comminuted cellulosic fibrous material (cellulosic/paper pulp) to be treated under pressure. Except for the components thereof relating to variable treatment, the apparatus 10 is conventional, including the basic vessel 11 shell, a pulp inlet 13 to the vessel, typically at the bottom thereof, a pulp outlet 14 from the vessel, typically at the top thereof, and a screen of a screen assembly 15 defining a surface of revolution upstanding within the vessel, and cooperating with the interior wall of the vessel 11 to define the annular first interior volume 12. Extraction means are also provided for withdrawing liquid from the pulp through the screen, and including means defining a second interior volume within the vessel 11 (and within the screen assembly 15) for receiving the extracted liquid. The basic screen assembly is conventional, including a screen, back wall, and connecting elements.

The extraction means comprise—according to the present invention—main extraction conduit 19, headers 17 and 18, and first and second conduits 20, 21, respectively extending upwardly from the headers 17, 18 to the top of the vessel 11.

The efficiencies associated with a variable or multi-stage vessel are achieved by providing a first treatment liquid introduction means, comprising the header 22 and associated valve assemblies 23 for introducing a first treatment liquid into the first interior volume 12 at one vertical position of the vessel 11, and a second liquid treatment introduction means comprising header 24 and conventional valve assemblies 25, for introducing a second treatment liquid, distinct from the first liquid, into the first interior volume 12 at another vertical position. A third, or part of the second, treatment liquid may also be introduced at other vertical positions along the vessel 11, such as at the introduction points 26, 26' illustrated in FIGS. 1A, 1B, and 5.

Figure 3:
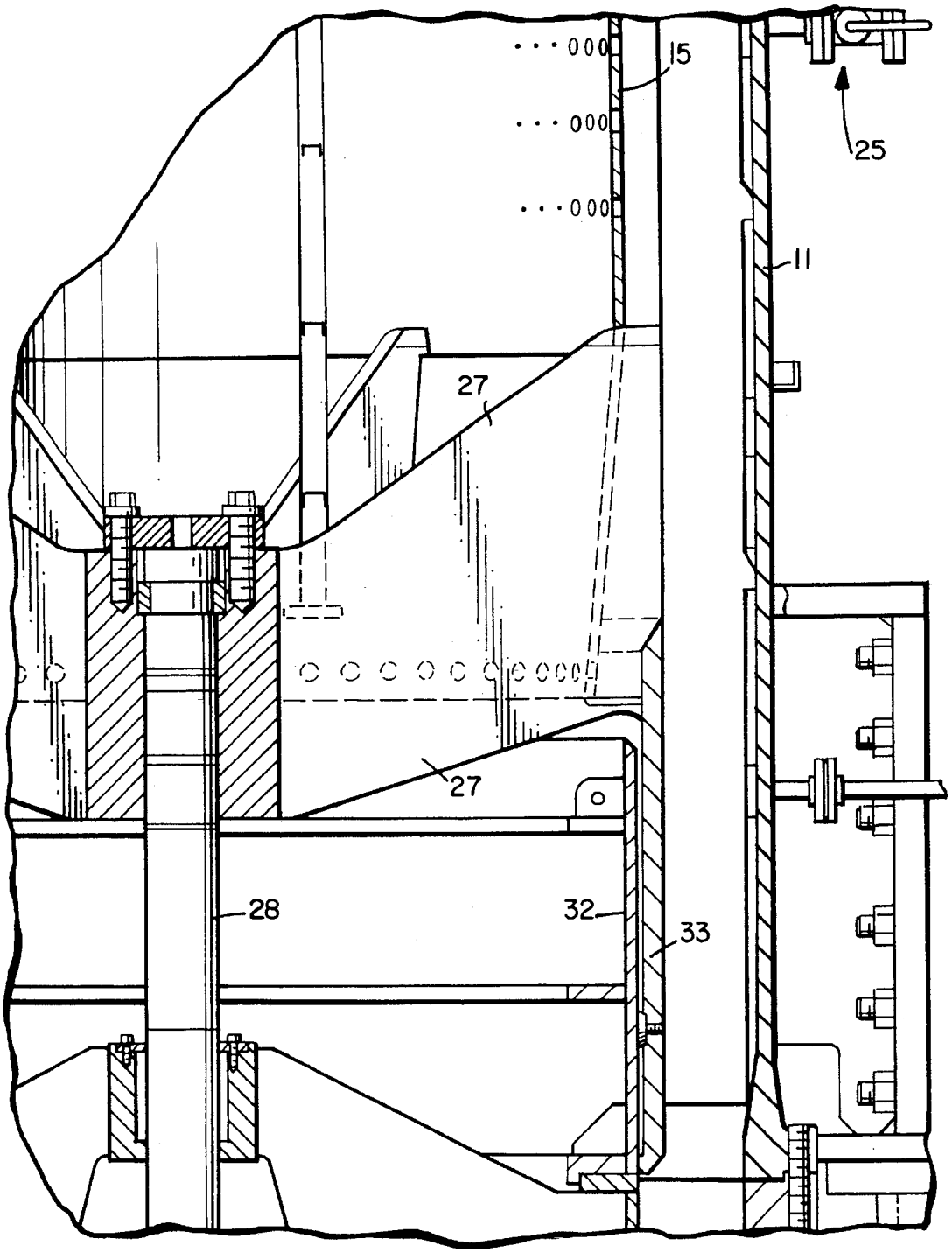
FIG. 3 is a detail cross-sectional view adjacent the bottom of the pressure diffuser of FIG. 1B.

The details of the treatment liquid introduction—including the configuration of the valve assemblies 23, 25, and flow directing components interiorly of the wall of the vessel 11 —except for the fact that multiple separate flows are provided, are conventional, as are the rest of the components of the apparatus except for the particular extraction means. Conventional components include means for effecting vertical reciprocation of the screen assembly 15. Such means includes a spider 27 connected to a rod 28 extending interiorly of the pulp inlet 13 and third liquid extraction outlet 19, and connected at the bottom thereof to a conventional reciprocating power source (e.g. hydraulic cylinder) 29. The spider 27 and shaft 28 are seen in both FIGS. 1B and 3, and 29 is seen in FIG. 1B.

Other conventional components associated with the screen assembly 15 reciprocation are provided by bearing means 30, adjacent the top end of the screen assembly 15 (see FIGS. 1A and 4), with a bearing surface 31 associated with the screen assembly 15 engaging the stationary bearing means 30, and a lower bearing means 32 (FIG. 3) with the bottommost portion of the screen assembly 15 having a bearing surface 33 engaging the stationary surface 32. As the rod 28 is reciprocated up and down, the screen assembly 15 slides on the bearing means 30–33. The reciprocation is in the same manner as is conventional in pressure diffusers, namely the screen assembly 15 moves up slowly, and is reciprocated downwardly quickly in order to backflush the screen openings to prevent clogging thereof.

Other conventional components associated with the apparatus 10 include the ladders 35 disposed in various compartments so that maintenance work can be done when the device is shut down, a discharge scraper assembly 36 adjacent the pulp outlet 14 (a motor—not shown—powers the discharge assembly 36), and an access way 38 into the vessel 11.

According to the invention, effective variable, multiple stage action is achieved by providing a tubular baffle 40 having a first, top end 41, and a second, preferably open bottom end 42. The bottom end 42 may have a steel grate 43 therein. The baffle typically extends the majority of the length of the second interior volume 16 (about 55–75% of the screen assembly 15 length) and requires liquid passing through the openings in the screen assembly 15 to pass down to the means defining through-extending large openings 44, 45 disposed in the otherwise solid wall of the tubular baffle 40 adjacent the headers 17, 18, so that liquid flows into the header therethrough.

Figure 4:
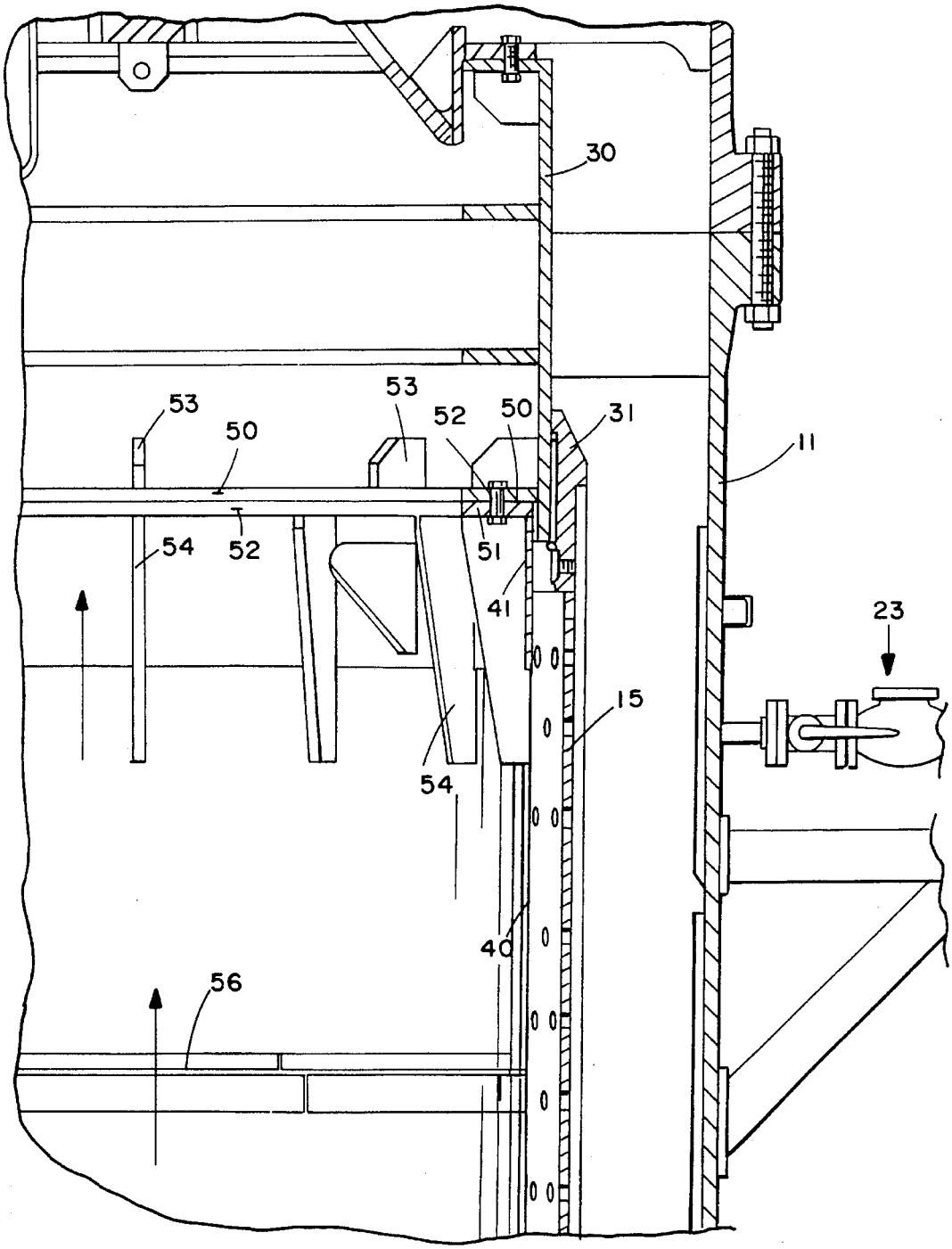
FIG. 4 is a detail cross-sectional view at the mounting between the screen and baffle adjacent the top of the pressure vessel of FIG. 1A.

FIG. 4 illustrates details of the manner in which the tubular/cylindrical baffle 40 is mounted within the vessel 11.

The top portion 41 thereof is essentially generally aligned with the top of the screen assembly 15 when the screen is in the lowermost position (as illustrated in FIG. 4). Preferably the baffle 40 is hung from a bottom, interior rim 50 of the stationary bearing 30, an annular flange 51 being connected to the rim 50 by a plurality of fasteners 52 around the circumference of each. Preferably, braces 53, 54 are welded to the elements 50, 51 respectively to support them. Note that since the elements 50, 51 are annular, they do not impede the free flow of liquid up to the discharge conduit/header 18.

As seen most clearly in FIG. 4, but also visible in FIG. 1A, an interior partition 56 can also be provided near, but spaced from, the first end 41 of the tube/cylinder baffle 40, which can provide support for the baffle 40, and also can support the topmost portion of the ladder 35 if desired. The partition 56 is apertured, however, to allow free flow of liquid therethrough.

Figure 2:
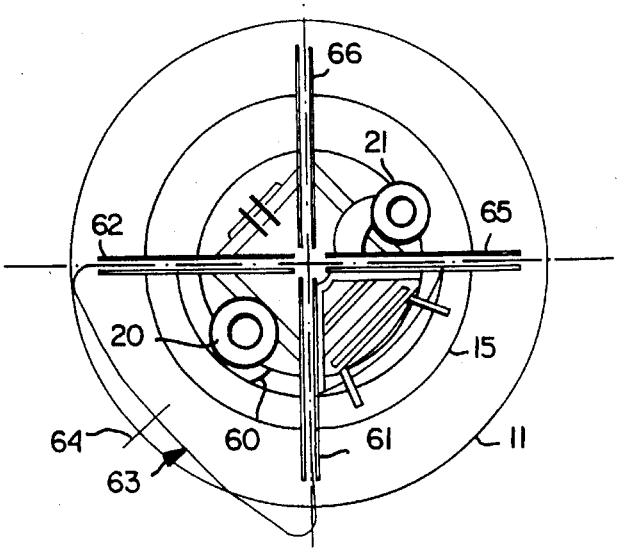
FIG. 2 is a detail cross-sectional view adjacent the top of the diffuser of FIGS. 1A and 1B, showing extraction arms thereat.

The first and second conduits 20, 21 from the headers 17, 18, respectively preferably communicate with extraction arms provided at the top of the vessel 11. For example as seen in FIGS. 1A and 2, the first conduit 20 may open up into an interior chamber 60 at the top of the vessel 11 (but below the discharge mechanism 36), which chamber 60 is defined on two sides thereof by the extraction arms 61, 62, the arms 61, 62 having openings thereon in communication with the chamber 60. If desired the arms 61, 62 can be connected to a header—shown schematically by line 63 in FIG. 2—which has a common outlet 64 of extracted liquid from the intermediate portion of the vessel 11 (having passed through the openings 44 into the header 17).

The second conduit 21, from the second header 18, is connected directly to an extraction arm 65, which is discharged from the top of the vessel 11. For symmetry, and to allow the possibility of adding another extraction arm if necessary, and to provide support for the interior components, a fourth extraction arm 66 (see FIG. 2) may be provided if desired.

Figure 5:
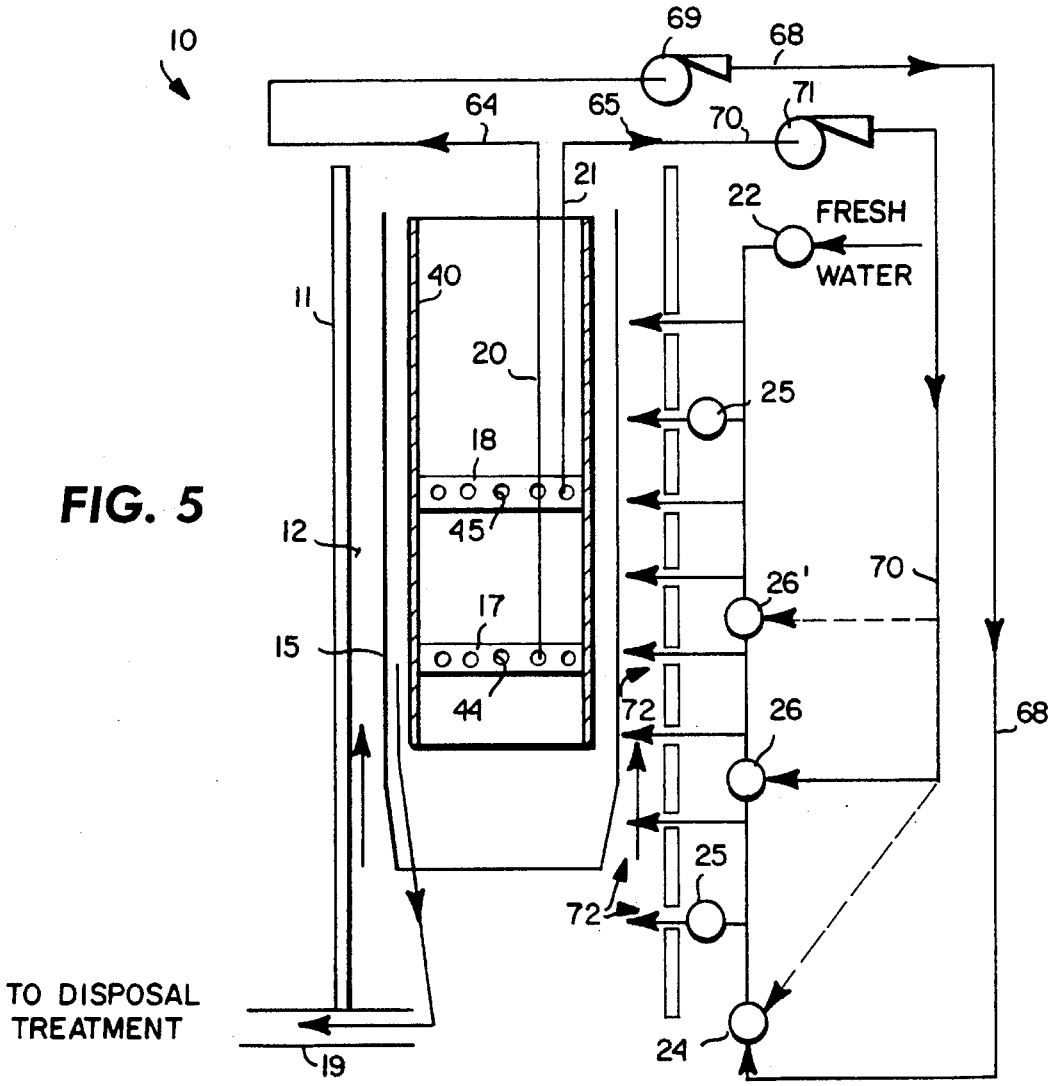
FIG. 5 is a schematic, partial, cross-sectional view illustrating the flows of liquid and pulp in the vessel of FIGS. 1A & 1B, and the preferred interrelationship therebetween.

The flow of fluent material in the practice of the method according to the invention, and utilizing the apparatus heretofore described, is best seen from the schematic of FIG. 5. Pulp flows upwardly in first interior volume 12, and is subjected to treatment liquid associated with all of the treatment introduction points indicated by the horizontal arrows on the right of FIG. 5. Typically the dirtiest extracted liquid is from header 17. The extracted liquid from header 17 passes upwardly in conduit 20, being discharged from connection 64 and being pumped into line 68, as under the influence of pump 69, and is introduced at the bottom header 24 as a recirculated treatment liquid. Slightly less dirty extracted liquid is extracted by second header 18 and passes upwardly through second conduit 21, to be discharged through arm 65 at the top of the vessel 11, passing into conduit 70 and being pumped, under the influence of pump 71. The liquid in conduit 70 is a third liquid, distinct from the fresh water added in header 22 and the dirtier liquid in conduit 68, and may be introduced at an intermediate point or points, such as through the Ts or valves 26, 26'. Of course the dirtiest extracted liquid is discharged from the bottom of the vessel 11 through the bottom extraction conduit 19.

Where a pure two stage treatment is desired, the conduit 70 may be connected to the header 24. Then the diffuser 10 will operate generally in the same way as that disclosed in the parent application. However according to the present invention a great deal of variability is provided in controlling the stages. For example valve 26 may be closed so that liquid from header 24 cannot be introduced above the first two (as illustrated in FIG. 5) introduction mechanisms 72. The valve 26' may be opened so that fresh wash liquid from source 22 is introduced at all the rest of the introduction mechanisms 72 along the height of the vessel 11. Alternatively, different stages may be provided by liquid introduced through one or both of valves 26, 26'.

The invention is applicable to any cellulosic fibrous material, but is particularly worthwhile—in the configuration illustrated—for softwood pulp. While variable multistage treatment can be used for hardwood pulp too, it is likely that the relative dimensions of many of the components would be changed before two-stage hardwood treatment was practiced. The temperature and pressure conditions will be maintained as conventional in single-stage pressure diffusers.

Figure 6:
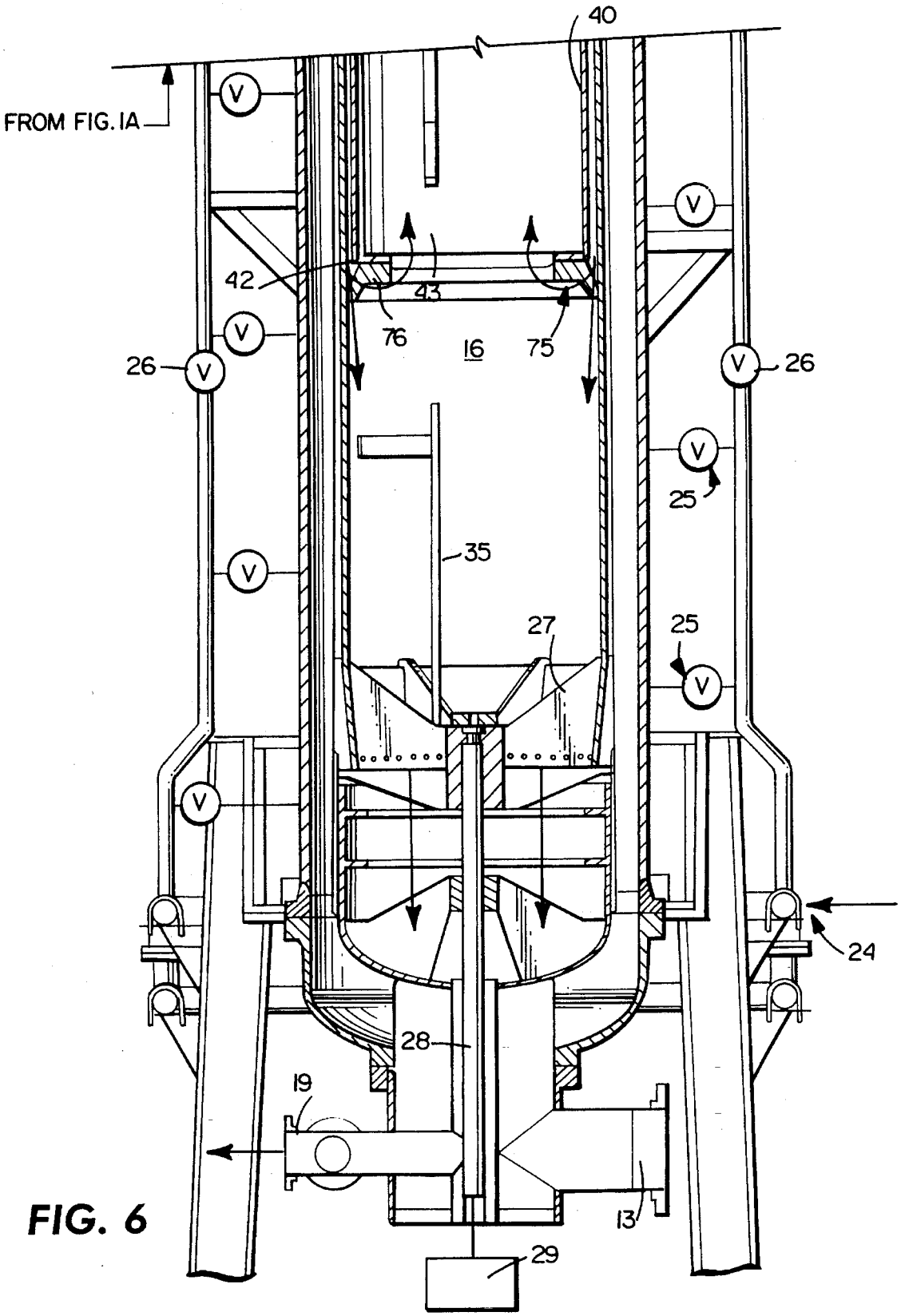
FIG. 6 is a view like that of FIG. 1B, only showing a sealing means mounted at the end of the cylinder for minimizing mixing between stages.
Figure 7:
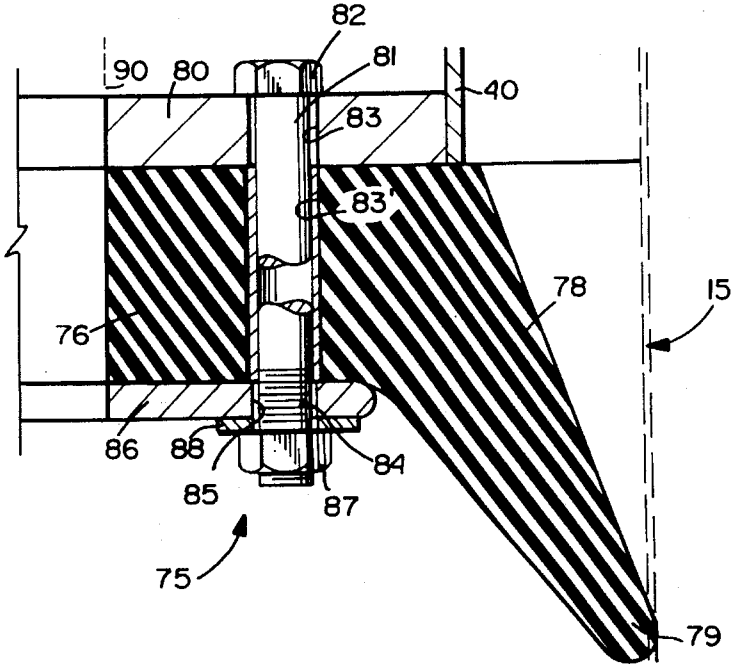
FIG. 7 is a cross-sectional detail view of a part of the sealing means of FIG. 6, also showing mounting elements associated therewith.

Another embodiment according to the invention is illustrated in FIGS. 6 and 7. This embodiment differs from the FIGS. 1A and 1B embodiment only in the provision of a sealing means 75 for minimizing mixing of the liquids between the stages. The means 75 preferably comprises—as illustrated in FIGS. 6 and 7—an annular sealing element 76 of flexible, elastomeric, material, such as ethylene propylene rubber (EPDM). The element 76 has an integral annular skirt 78 which flares outwardly and downwardly and with a bottom portion 79 thereof biased into engagement with the screen assembly 15, and substantially preventing movement of liquid past it, from one stage to the other.

As seen in FIG. 7, the element 76 is mounted to the bottom of annular end wall 80 of cylinder 40 by a plurality of uniformly spaced fastening elements, one fastener (bolt) 81 illustrated in FIG. 7. The bolt 81 has a head 82 engaging the top of end wall 80, and its body passes through an opening 83 in wall 80, and through an aligned opening 83' in element 76. A screw threaded portion 84 is provided at the end of the bolt 81, and passes through an opening 85 in an annular rigid material (e.g. carbon steel) reinforcing plate 86 at the bottom of the element 76, interior of the skirt 78. A nut 87 may engage the screw threaded portion 84 of the fastener 81, and a washer 88 may be utilized if desirable. Note that the interior surfaces of the wall 80, element 76, and plate 86 are on a common vertical line 90, as seen in FIG. 7.

Figure 8:
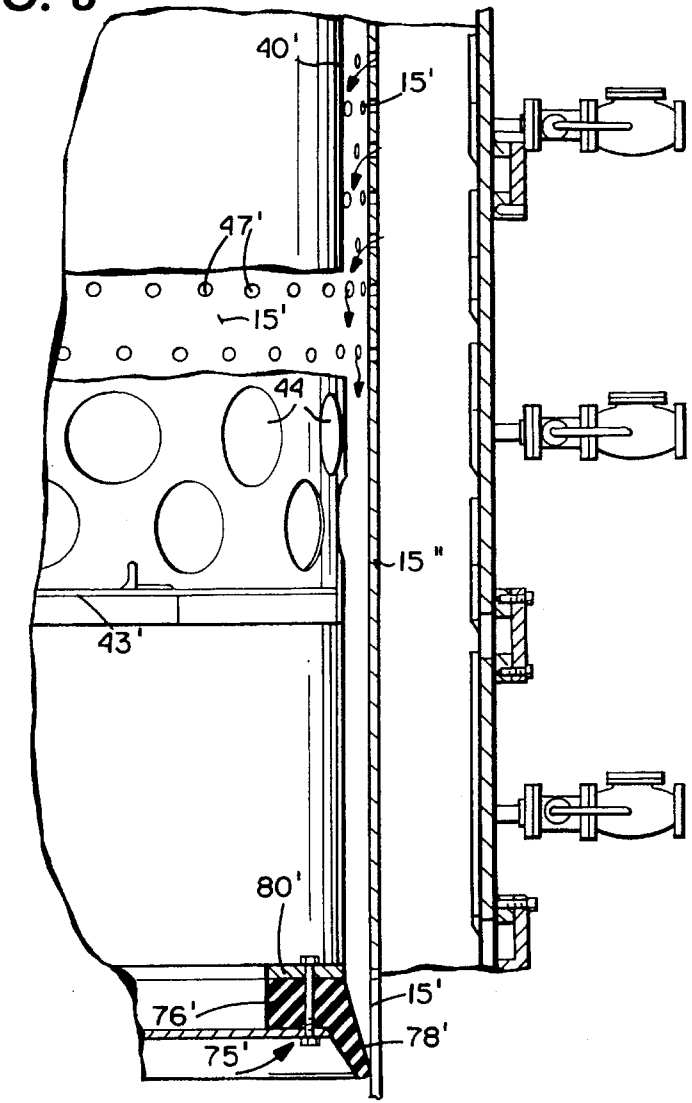
FIG. 8 is a detail side view, partly in cross section and partly in elevation, of another embodiment of the apparatus of the parent application, showing a sealing element like that of FIGS. 6 and 7 associated therewith.

FIG. 8 illustrates a modification of the cylinder assembly/diffuser of the parent application, like FIG. 2 thereof, only showing a flexible material sealing means 75' as according to the invention. The sealing means 75' includes a body 76', and an annular skirt 78' which is biased by its inherent resiliency into sealing relationship by the screen assembly 15'. The structures 15', 15", 43', and 47' are like the structures in FIG. 2 of the parent application of the same reference numeral without a "'".

It will thus be seen that according to the present invention a variable stage pressure diffuser, and a method of treating paper pulp, have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A screen and baffle assembly for a treatment vessel, comprising:

an annular screen assembly elongated in a first dimension about an axis and having first and second ends, and defining an interior volume;

bearing means disposed at the first end of said screen assembly;

connection means disposed at the second end of said screen assembly, connecting said screen assembly to a power source;

said power source comprising means for reciprocating said screen assembly up and down within said vessel;

an inner hollow cylinder, solid walled along the vast majority of the length thereof, mounted within said screen assembly and elongated in the same dimension of elongation as said screen assembly, and coaxial therewith and having a first end and a second end;

said inner cylinder and said screen assembly bearing means engaging at said first end of each;

said cylinder having a length roughly about 55–75% of the screen assembly length; and means defining a first plurality of radially extending openings in said cylinder adjacent said second end thereof, communicating with a first header disposed interiorly of said inner cylinder, with a first conduit extending from said headers to the exterior of the treatment vessel.

2. An assembly as recited in claim 1 further comprising means defining a second plurality of radially extending openings in said cylinder between said first and second ends thereof, and communicating with a second header disposed interiorly of said inner cylinder, with a second conduit extending from said second header to the exterior of said vessel.

3. An assembly as recited in claim 2 further comprising an extraction first arm extending radially outwardly from said vessel above said inner cylinder, and wherein said first conduit communicates with said first arm.

4. An assembly as recited in claim 2 further comprising first and second arms extending radially outwardly from said vessel above said inner cylinder, said first conduit connected to said first arm and said second conduit connected to said second arm.

5. An assembly as recited in claim 2 further comprising an extraction conduit disposed at the bottom of said vessel, said extraction conduit communicating with the interior volume of said annular screen assembly.

6. An assembly as recited in claim 5 wherein said cylinder is open at the second, bottom, end thereof so that the interior of said inner cylinder is in communication with said extraction conduit along with the rest oil the interior volume of said annular screen assembly.

7. An assembly as recited in claim 6 further comprising first treatment liquid means for introducing a first treatment liquid into the interior of said treatment vessel, between said annular screen assembly and an inner surface of said treatment vessel, and a second treatment liquid introduction means vertically spaced from said first treatment liquid introduction means, and for introducing a second liquid, distinct from said first liquid, into the volume between said treatment vessel and said annular screen assembly.

8. An assembly as recited in claim 7 further comprising a third treatment liquid introduction means vertically spaced from said first and second liquid treatment introduction means, and for introducing a third liquid, distinct from said first and second liquids, into the volume between the interior of said treatment vessel and said annular screen assembly.

9. An assembly as recited in claim 1 further comprising an extraction first arm extending radially outwardly from said vessel above said inner cylinder, and wherein said first conduit communicates with said first arm.

10. An assembly as recited in claim 1 further comprising first treatment liquid means for introducing a first treatment liquid into the interior of said treatment vessel, between said annular screen assembly and an inner surface of said treatment vessel, and a second treatment liquid introduction means vertically spaced from said first treatment liquid introduction means, and for introducing a second liquid, distinct from said first liquid, into the volume between said treatment vessel and said annular screen assembly.

11. An assembly as recited in claim 10 further comprising a third treatment liquid introduction means vertically spaced from said first and second liquid treatment introduction means, and for introducing a third liquid, distinct from said first and second liquids, into the volume between the interior of said treatment vessel and said annular screen assembly.

12. A screen and baffle assembly for a treatment vessel, comprising:

an annular screen assembly elongated in a first dimension about an axis and having first and second ends;

bearing means disposed at the first end of said screen assembly;

connection means disposed at the second end of said screen assembly, adapted to connect said screen assembly to a power source;

an inner hollow cylinder mounted within said screen assembly and elongated in the same dimension of elongation as said screen assembly, and coaxial therewith and having a first end and a second end;

said inner cylinder and said screen assembly bearing means engaging at said first end of each;

said cylinder having a length less than the length of the screen assembly; and flexible sealing means disposed at the second end of said cylinder and making sealing engagement with said screen assembly to substantially prevent passage of liquid between said cylinder and said screen assembly past said sealing means.

13. An assembly as recited in claim 12 wherein the length of said cylinder is roughly about 55–75% of the screen assembly length.

14. An assembly as recited in claim 13 further comprising means defining a plurality of radially extending openings in said cylinder adjacent said second end thereof.

15. An assembly as recited in claim 14 further comprising a transverse plate closing off the interior of said cylinder adjacent said second end thereof.

16. An assembly as recited in claim 15 wherein said screen assembly has a blanked portion at the portion thereof adjacent said transverse plate.

17. An assembly as recited in claim 14 further comprising a transverse plate closing off the interior of said cylinder adjacent, but spaced from, said second end thereof.

18. An assembly as recited in claim 13 further comprising means defining a first plurality of radially extending openings in said cylinder adjacent said second end thereof, and communicating with a first header disposed interiorly of said inner cylinder, with a first conduit extending from said header to the exterior of the treatment vessel.

19. An assembly as recited in claim 12 wherein said sealing means comprises an annular element of elastomeric material, having an integral annular skirt extending downwardly from said cylinder and into engagement with said screen assembly.

20. An assembly as recited in claim 19 wherein said flexible material is ethylene propylene rubber.

21. An assembly as recited in claim 19 wherein said cylinder includes an annular end wall, and further comprising means for mounting said annular element to said annular end wall of said cylinder, said mounting means comprising an annular rigid material plate at the bottom of said annular element, and a plurality of fasteners extending through said annular end wall, rigid material annular plate, and annular element.

* * * * *